US005617766A

United States Patent [19]

Tsuji et al.

[11] Patent Number: 5,617,766

[45] Date of Patent: Apr. 8, 1997

[54] TORQUE WRENCH DEVICE

[75] Inventors: Hiroshi Tsuji; Yoshiji Okayasu, both of Tokyo, Japan

[73] Assignee: Tonichi Manufacturing Co., Ltd., Tokyo, Japan

[21] Appl. No.: 566,483

[22] Filed: Dec. 4, 1995

Related U.S. Application Data

[63] Continuation of Ser. No. 309,100, Sep. 20, 1994, abandoned.

[30] Foreign Application Priority Data

Oct. 12, 1993 [JP] Japan ..... 5-254341
Oct. 12, 1993 [JP] Japan ..... 5-254342

[51] Int. Cl.[6] ..... B25B 23/159

[52] U.S. Cl. ..... 81/480; 81/184; 81/180.1; 81/177.2

[58] Field of Search ..... 81/180.1, 184, 81/185.2, 487, 489, 177.1, 177.2, 467–483

[56] References Cited

U.S. PATENT DOCUMENTS 1,196,252 8/1916 LeGrand ..... 81/480 X
2,713,281 7/1955 Poteet ..... 81/177.2
3,272,002 9/1983 Dickman ..... 81/423 X
4,535,659 8/1985 Yang ..... 81/478

FOREIGN PATENT DOCUMENTS 467451 8/1950 Canada ..... 81/478

*Primary Examiner*—D. S. Meislin
*Attorney, Agent, or Firm*—McAulay Fisher Nissen Goldberg & Kiel, LLP

[57] ABSTRACT

A torque wrench device has a torque wrench structure which includes a substantially tubular handle, a head pivotally secured to on end of the handle through a pivot pin, a toggle link connected to the head, a thruster coupled to the head through the toggle link, and a spring which resiliently urges the thruster towards the head. The device also has a clamp mechanism which is provided on an end of the head of the torque wrench structure and capable of clamping stem portions of a variety of types of wrenches by a resilient force exerted by a spring. The torque wrench structure may have an adapter support portion formed on one end of the head integrally therewith. In such a case, the torque wrench structure can be used together with an adapter engaged and held by the adapter support portion in such a manner as to allow adjustment of the position of the fulcrum at which the adapter is held by the torque wrench structure.

2 Claims, 8 Drawing Sheets

TORQUE WRENCH DEVICE

This is a continuation of application Ser. No. 08/309,100, filed Sep. 20, 1994 now abandoned.

BACKGROUND OF THE INVENTION

1. Field of the Invention

The present invention relates to a torque wrench device which can be combined with various types of commercially available wrenches such as a spanner wrench, ring spanner, ratchet wrench, hexagonal wrench key, wheel wrench and so forth, so as to enable the wrench to tighten an object with a required level of torque. The invention also is concerned with a torque wrench device which enables setting of the tightening torque without requiring adjustment of compression load of a compression coiled spring incorporated therein.

2. Description of the Related Art

A typical conventional torque wrench device designed for tightening a bolt or the like with a predetermined level of torque is shown in FIG. 1.

The torque wrench device has a tubular torque wrench handle 1. A head 2 is pivotally secured to an end of the handle 1 by means of a head pin 3. The handle 1 accommodates a thruster 5 for movement in the direction of axis of the handle 1. The thruster 5 and the head 2 are coupled to each other through a toggle link 4. The thruster 5 is urged towards the head 2 by a force exerted by a spring 6. Balls 7 are incorporated so as to reduce friction between the side surfaces of the head 2 and the inner surfaces of the handle 1. Numeral 8 designates a roller which serves to reduce friction between the thruster 5 and the inner surface of the handle 1. Numeral 9 designates an adjusting screw for adjusting the resilient urging force of the spring 6, while numeral 10 denotes a grip secured to the end of the handle 1 opposite to the head 2.

In tightening a bolt or the like, when the tightening load in terms of torque reaches a predetermined level of torque, the toggle link 4 starts to operate so that the head 2 collides with an abutment portion 100 of the handle 1, accompanied by an impacting sound and an abrupt reduction in the torque which inform the user of the tightening of the bolt or the like with predetermined level of torque.

One of the shortcomings of these prior art torque wrench devices is as follows. The torque wrench device described above is a consolidated torque wrench having a toggle link incorporated therein. A head-interchangeable torque wrench device also has been known which can be used in combination with different types of wrenches such as a ratchet wrench, spanner wrench and ring spanner, as disclosed in, for example, Japanese Utility Model Publication No. 49-17509. This known head-interchangeable torque wrench device, however, requires that all the different types of wrenches are designed specifically so as to be adapted to the torque wrench device. In other words, the known head-interchangeable torque wrench device is not a universal torque wrench which can be used in combination with a variety of types of wrenches such as diversified designs of ratchet wrench, spanner wrench, ring spanner and so forth. Consequently, it has been necessary to prepare a variety of types of heads corresponding to a variety of type of wrenches.

In addition, known head-interchangeable wrench devices have been produced in different standards by different manufacturers, thus hampering interchangeability of the torque wrench devices. In addition, it is not easy for ordinary users to purchase individual wrenches of different types, which causes inconvenience to the users.

Another shortcoming of the known torque wrench device is as follows. In the known torque wrench device as described, the tightening torque (compression load) is adjusted by varying the compression load of the spring 6 through rotating the adjusting screw 9 provided on the end of the handle 1. This means that the tightening torque is adjustable only over a range which is limited by the elastic characteristic of the spring. Thus, the known torque wrench device is adaptable only to a limited range of tightening torque. In other words, it has been impossible to adjust the tightening torque over an extensive range.

SUMMARY OF THE INVENTION

Accordingly, an object of the present-invention is to provide a universal torque wrench device in which a head of the torque wrench structure equipped with a toggle link is provided with a clamp mechanism capable of clamping a variety of types of commercially available wrenches such as a spanner wrench, a ring spanner, a ratchet wrench, a hexagonal wrench key, a wheel wrench or the like, whereby any desired wrench can be selectively coupled with the torque wrench structure to enable tightening of a bolt or the like with a predetermined level of tightening torque.

To this end, according to the present invention, there is provided a torque wrench device comprising: a torque wrench structure including a substantially tubular handle, a head pivotally secured to on end of the handle through a pivot pin, a toggle link connected to the head, a thruster coupled to the head through the toggle link, and a spring which resiliently urges the thruster towards the head; and a clamp mechanism provided on an end of the head of the torque wrench structure and capable of clamping stem portions of a variety of types of wrenches by a resilient force exerted by a spring.

It is another object of the present invention to provide a torque wrench device having a head adapter which provides a plurality of fulcrums for varying the length between the point at which manual force is exerted on the handle and the point at which the head exerts tightening force, so as to enable adjustment of the tightening torque over an extensive range.

To this end, according to another aspect of the present invention, there is provided a torque wrench device comprising, in combination: a torque wrench structure including a substantially tubular handle, a head pivotally secured to one end of the handle through a pivot pin, a toggle link connected to the head, a thruster coupled to the head through the toggle link, a spring which resiliently urges the thruster towards the head, and an adapter support portion formed on one end of the head integrally therewith; and an adapter engaged and held by the adapter support portion in such a manner as to allow adjustment of the position of the fulcrum at which the adapter is held by the torque wrench structure.

These and other objects, features and advantages of the present invention will become clear from the following description of the preferred embodiments when the same is read in conjunction with the accompanying drawings.

DESCRIPTION OF THE PREFERRED EMBODIMENTS

A first embodiment of the present invention will be described with specific reference to FIGS. 1 to 8.

Figure 1:
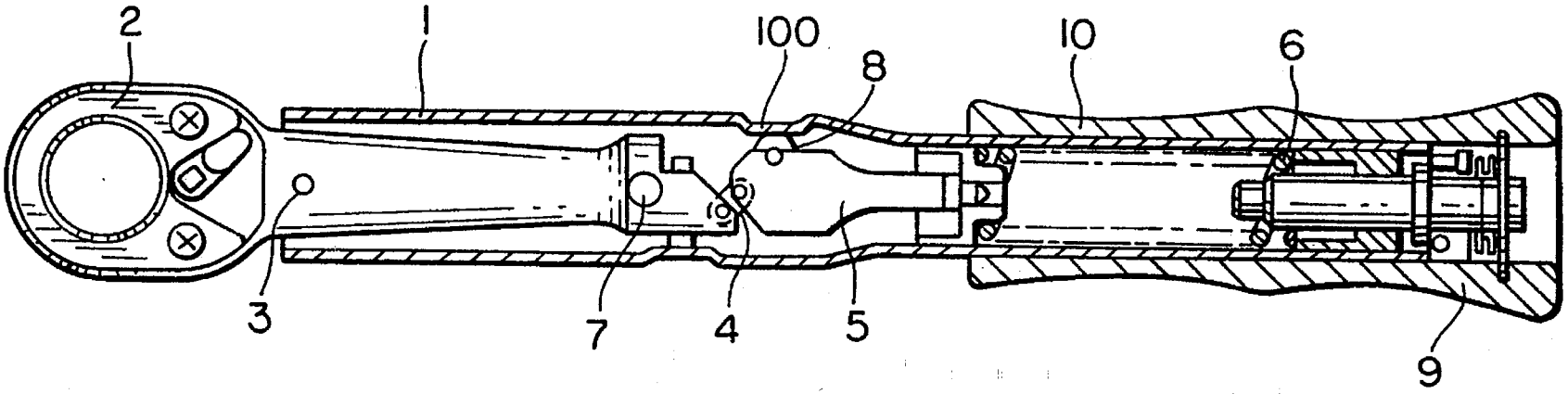
FIG. 1 PRIOR ART
FIG. 1 is an illustration of the construction of a known torque wrench device.
Figure 2:
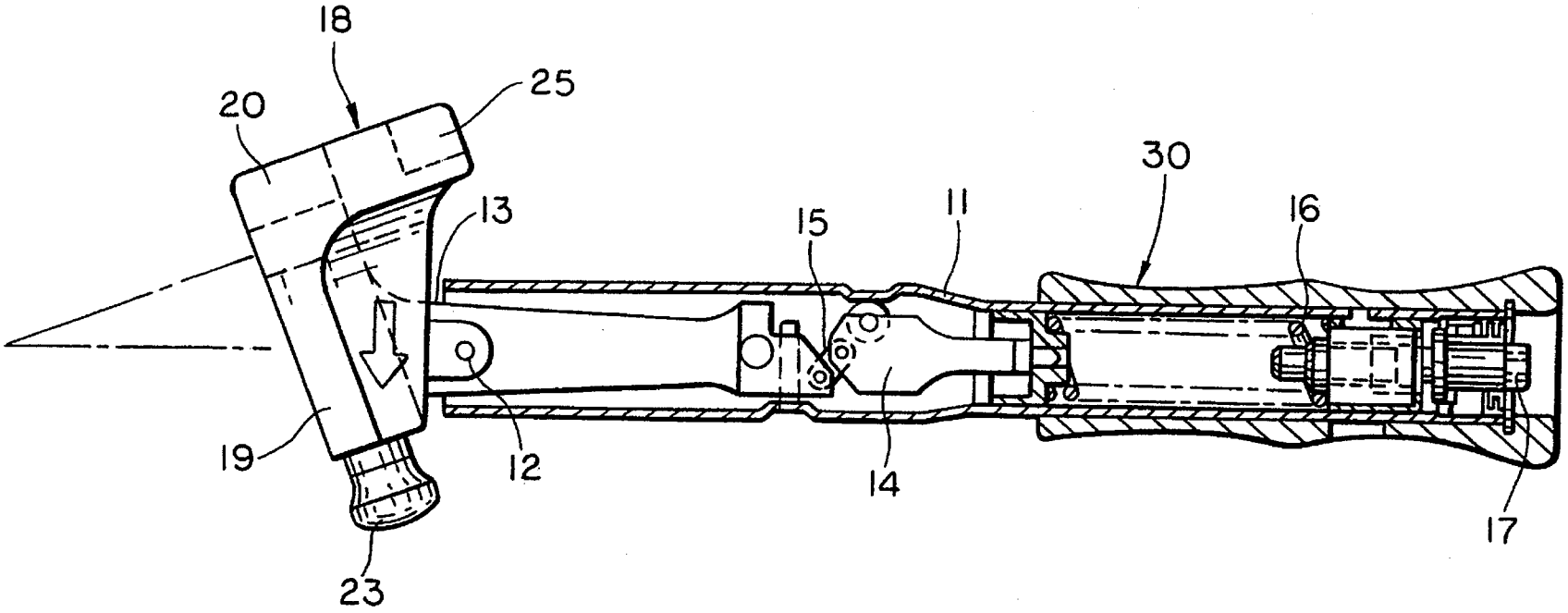
FIG. 2 is an illustration of the construction of an embodiment of the torque wrench in accordance with the present invention.
Figure 3:
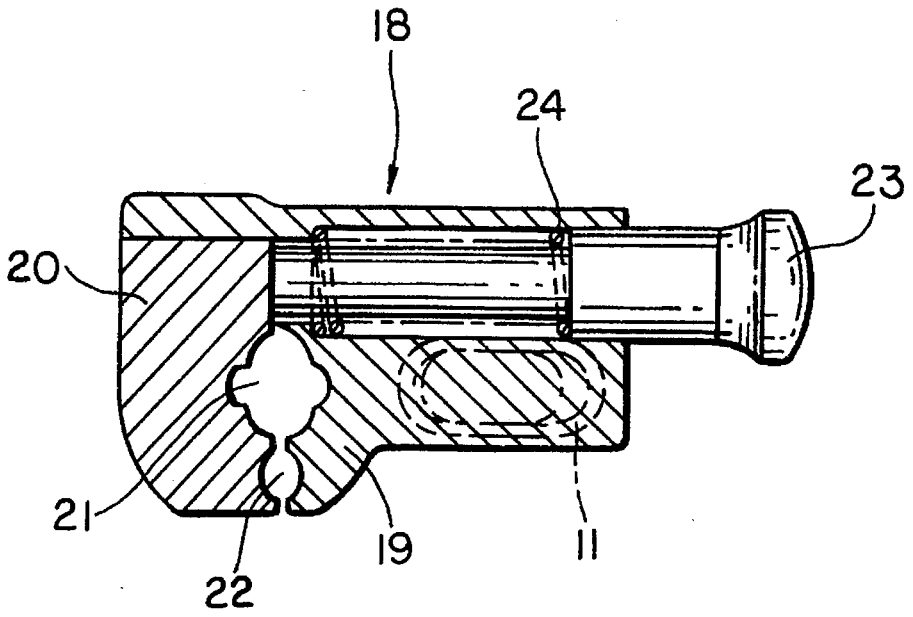
FIG. 3 is a sectional view of a critical portion of the embodiment shown in FIG. 2.
Figure 4:
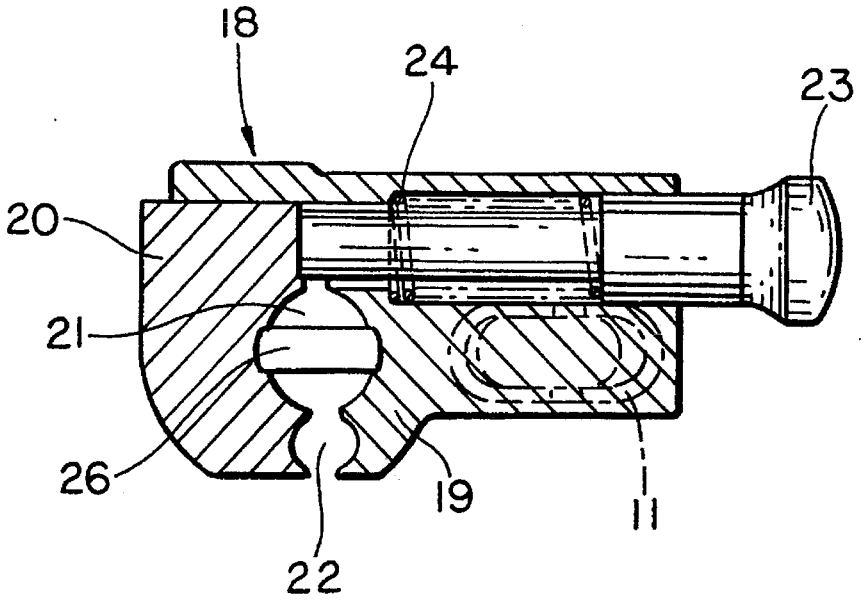
FIG. 4 is an illustration of operation of a critical portion of the embodiment shown in FIG. 2.

Referring first to FIGS. 2 to 4, a torque wrench device embodying the present invention has a tubular or cylindrical torque wrench handle 11. A head 13 is pivotally secured to one end of the handle 11 by means of a head pin 12 which penetrates this end of the handle 11.. The handle 1 accommodates a known tightening torque detecting means including a toggle link 14 connected to the rear end of the head 13 and a thruster 15 which is coupled to the head 13 through the toggle link 14. The torque wrench handle 11, head 13, toggle link 14 and the thruster 15 in cooperation provide a torque wrench structure generally denoted by 30. Numeral 16 designates a spring which resiliently urges the thruster 15 towards the head 13, while 17 designates an urging force adjusting screw which enables adjustment of the urging force exerted by the spring 16. A clamp mechanism 18 is provided on the end of the head 13 integrally therewith. The clamp mechanism 18 has a fixed frame member 19 integral with the head 13 and a movable frame member 20 which is held for movement relative to the fixed frame member 19. The fixed frame member 19 and the movable frame member 20 provide wrench clamping portions 21 and 22. The movable frame member 20 is adapted to be moved by a force exerted through an operation rod 23 which is fixed to the movable frame member 20, against the force of a spring 24 which acts between the fixed frame member 19 and the operation rod 23, so as to vary the spans of the clamping portions 21 and 22. A wrench support portion 25 is formed on the fixed frame member 19 integrally therewith.

Thus, the described embodiment of the invention features the clamp mechanism 18 provided on the end of the head 13 and capable of engaging and holding a wrench.

Figure 5:
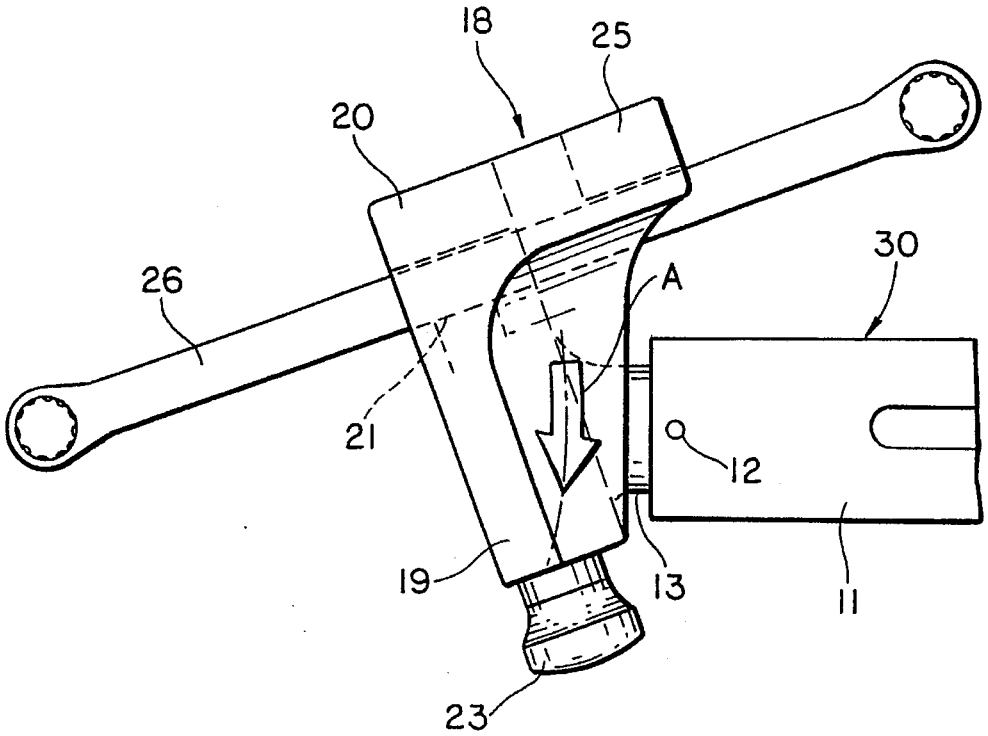
FIG. 5 is a plan view of a critical portion of the embodiment shown in FIG. 2 in a state combined with a ring spanner.
Figure 6:
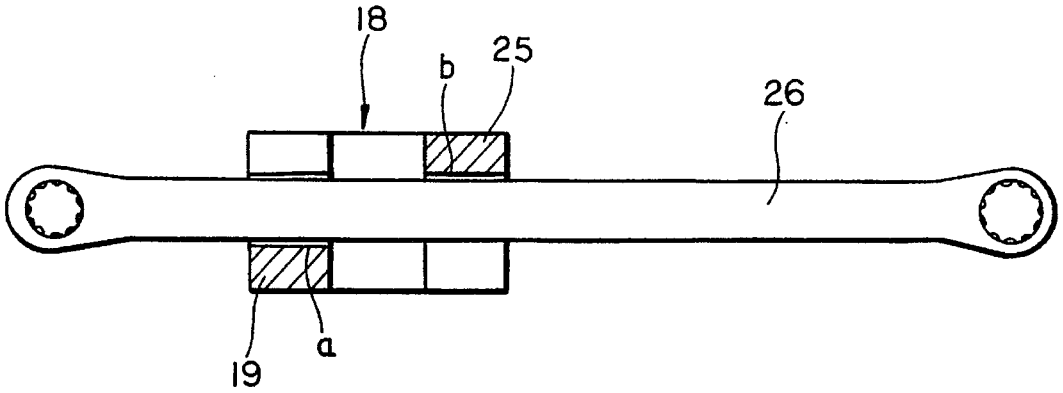
FIG. 6 is an illustration of operation of the embodiment in the state shown in FIG. 5.

The operation of this embodiment will be described with reference to FIGS. 5 and 6.

It is assumed here that the described torque wrench device is used in combination with a ring spanner 26 having a stem portion. The stem portion is held in the wrench clamping portion 21 formed between the fixed frame member 19 and the movable frame member 20 of the clamp mechanism 18. When the torque wrench structure is rotated in the direction for tightening a bolt or the like as indicated by an arrow A, the stem portion of the ring spanner 26 is received by a contact surface "a" presented by the fixed frame member 19 and a contact surface "b" presented by the wrench support portion 25, so that the tightening torque exerted on the torque wrench structure 30 is effectively transmitted to the ring spanner 26.

After completion of tightening of the bolt with the ring spanner 26, the operation rod 23 is pushed against the resilient force of the spring 24, so that the wrench clamping portion 21 is opened to allow the ring spanner 26 to be smoothly detached from the torque wrench structure.

Figure 7:
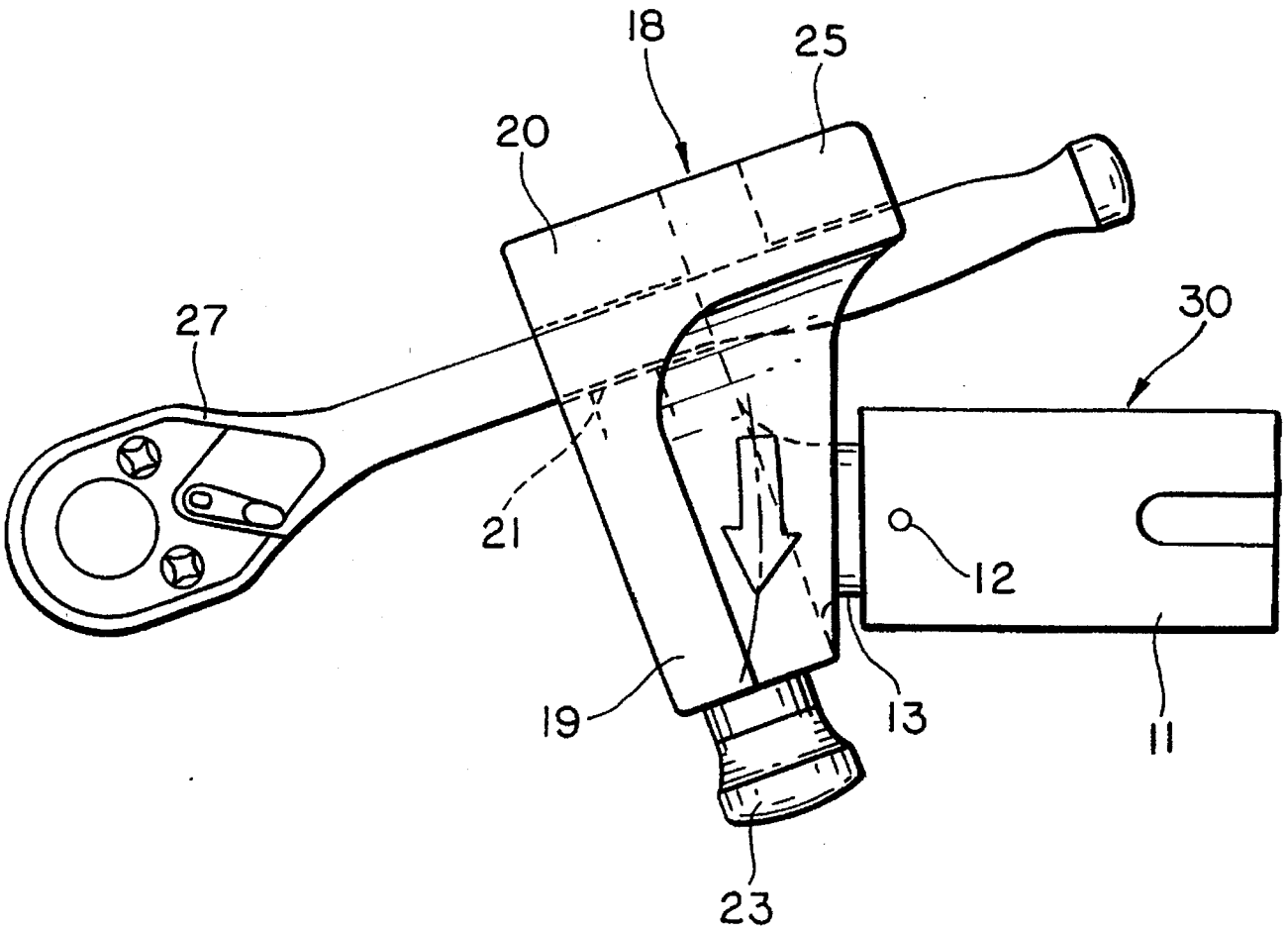
FIG. 7 is a plan view of a critical portion of the embodiment shown in FIG. 2 in a state combined with a ratchet wrench.
Figure 8:
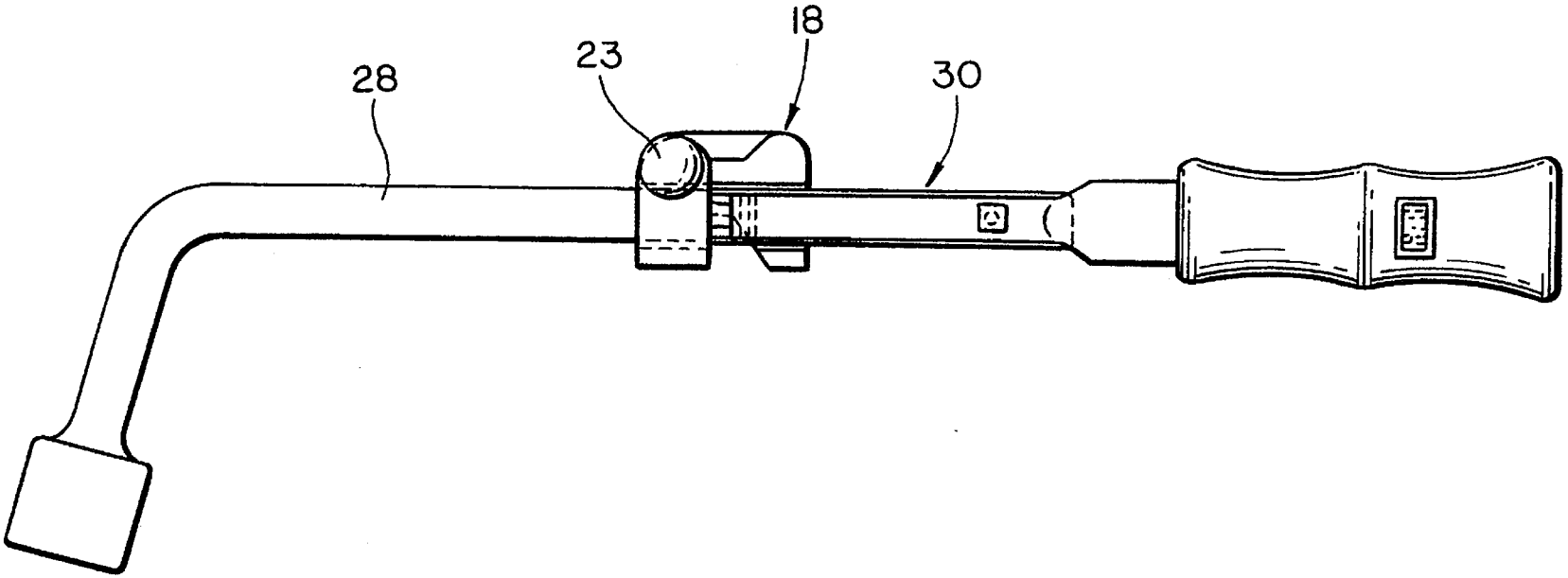
FIG. 8 is a plan view of a critical portion of the embodiment shown in FIG. 2 in a state combined with a wheel wrench.

When a ratchet wrench 27 is to be used in place of the ring spanner 26, a stem portion of the ratchet wrench 27 is clamped by the wrench clamping portion 21 as shown in FIG. 7. Similarly, tightening of a wheel wrench 28 is possible as illustrated in FIG. 8.

In the illustrated embodiment, each of the wrenches 26, 27 and 28 is clamped by one clamping portion 21 of the clamping portions 21 and 22 provided in the clamp mechanism 18. As shown in FIGS. 3 and 4, the horizontal axis of the wrench clamping portion 21 coincides with the horizontal axis of the torque wrench structure 30. Therefore, when the wrench clamped by the wrench clamping portion 21 is rotated in the bolt tightening direction by the torque exerted through the torque wrench structure 30, the torque is effectively transmitted to the wrench without generation of any couple of force, whereby the manual force can be stably exerted on the wrench.

The other wrench clamping portion 22 of the clamp mechanism 18 can conveniently be used for holding a wrench of a smaller size. When this wrench clamping portion 22 is used, it is impossible to eliminate the couple of force, because of the presence of a height difference between the horizontal central axis of the wrench clamping portion 22 and the horizontal axis of the torque wrench structure 30. This wrench clamping portion 22, however, can suitably clamp wrenches of smaller sizes, thus enhancing utility of the torque wrench device.

It is to be noted that the clamping performed by each clamping portion 21, 22 is performed by making use of the resilient force of the spring 24. Therefore, the span of each clamping portion is freely adjustable to receive a variety of shapes and sizes of wrenches.

Obviously, the torque wrench device of the described embodiment can be used also for the purpose of loosening a bolt or the like, when the torque wrench structure 30 is turned upside down.

As will be understood from the foregoing description, the first embodiment of the universal torque wrench device of the present invention has: a torque wrench structure 30 including tubular handle 11, a head 13 pivotally secured to the handle 11 by means of a pivot pin 11, a toggle link 14 connected to the head 13, a thruster 15 coupled to the head 13 through the toggle link 14, and a spring 16 for resiliently urging the thruster 15 towards the head 13; and a clamp mechanism 18 provided on the end of the head 13 and capable of clamping, by a resilient force exerted by a spring 24, the stem portion of a variety of types of wrenches. According to this arrangement, it is possible to mount a variety of types and shapes of wrenches to the torque wrench structure 30 having the toggle mechanism, so that tightening of a variety of types of bolts and screws can be performed securely and smoothly by the torque wrench structure which can commonly hold different types of wrenches corresponding to the types of the bolts or screws to be tightened.

Figure 9:
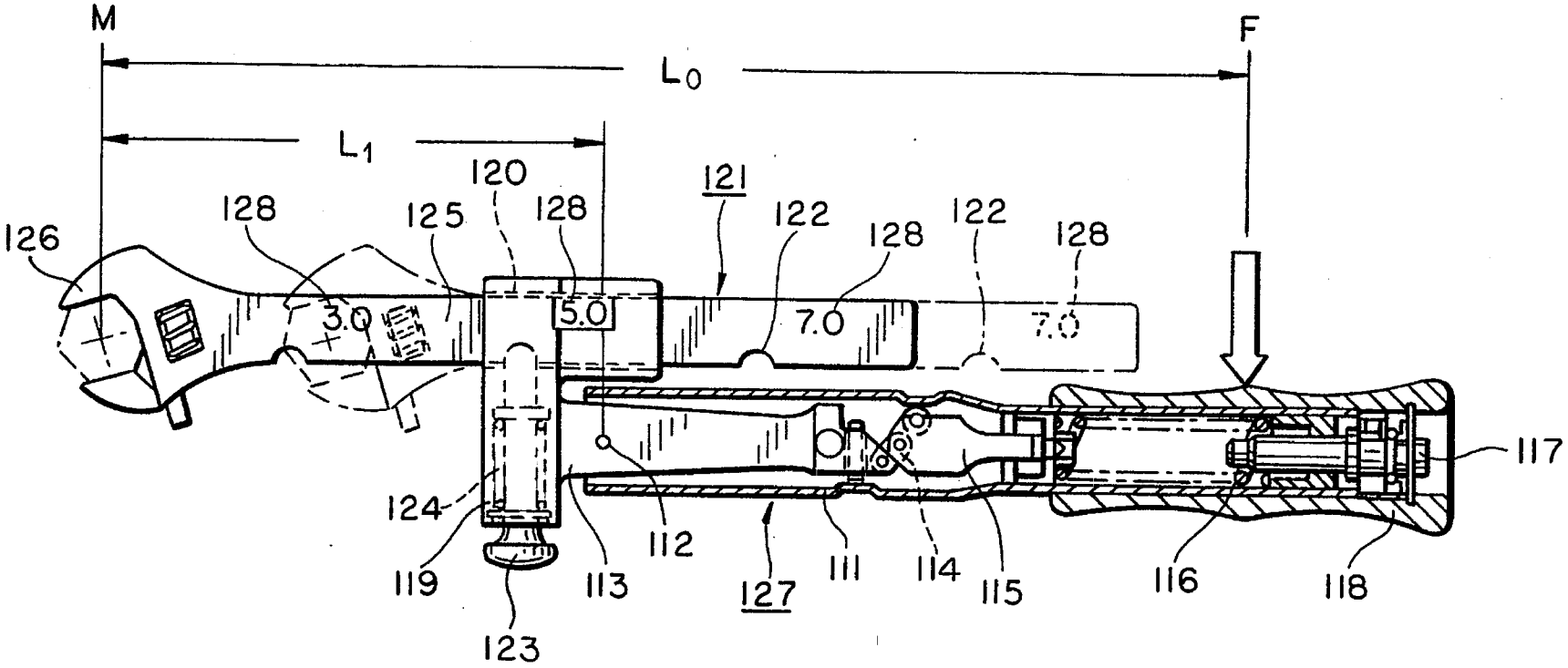
FIG. 9 is an illustration of a torque wrench device as another embodiment of the present invention.
Figure 10:
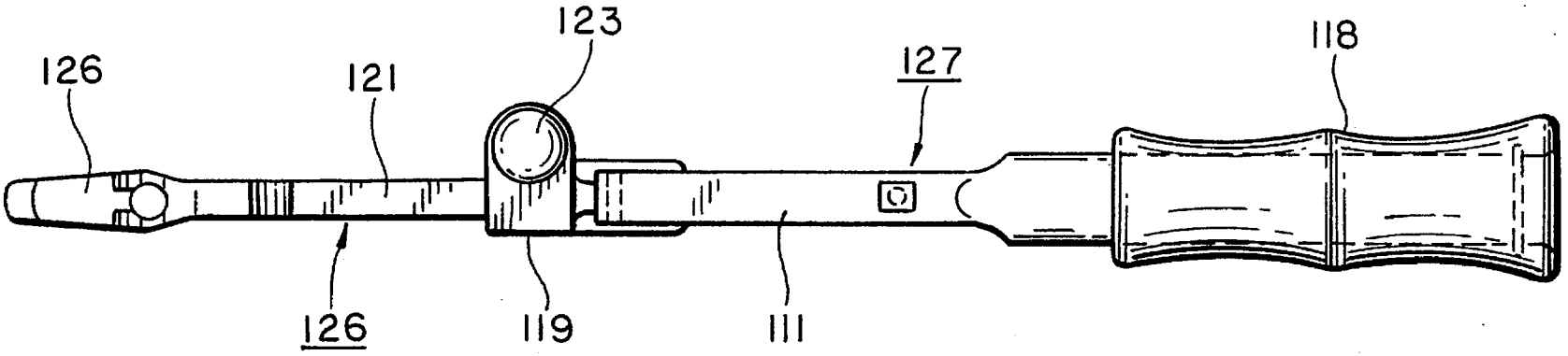
FIG. 10 is a side elevational view of the torque wrench device shown in FIG. 9.

A description will now be given of a second embodiment of the present invention with specific reference to FIGS. 9 and 10.

Referring to these Figures, a head pin 112 penetrates an end of a substantially tubular torque wrench handle 111. A head 113 is pivotally secured to the end of he handle 111 by means of the head pin 112. The handle 111 accommodates a thruster 45 for free movement in the direction of axis of the handle 11. The thruster 115 is coupled to the head 113 through a toggle link 114. The thruster 115 is urged towards the head 113 by the resilient force exerted by a spring 116 accommodated in the handle 111. Numeral 117 denotes an adjusting screw for adjusting the resilient force of the spring 116 acting on the thruster 115 while numeral 118 designates a grip provided on the end of the handle 111 opposite to the head 113. These members in cooperation provide a torque wrench structure 127.

An adapter support portion 119, which is an integral part of the head 113 provided on an end of the head 113, has an adapter receiving through-hole 120 which extends through the head 113 in a direction parallel to the axis of the head 113, a retainer pin 123 adapted to be received in and engaged by one of recesses 122 formed in an edge of an adapter 121 which is adapted to be received in the hole 120, and a spring 124 which resiliently urges the pin 123 into a selected recess 122.

The adapter 121 has an insert portion 125 capable of being received in the adapter insertion through-hole 120, and a bolt-engaging portion 126 provided on one end of he insert portion 125 and having a structure similar to that of monkey-type adjustable wrench. The screw-engaging portion 126, however, may be a different type of wrench, such as a ring spanner, ratchet wrench or the like. In order to enable an easy indication of the set torque value, a scale or gradation 128 may be formed on the surface of the insert portion 125 of the adapter 121 so as to indicate torque values corresponding to the respective recesses 122.

Thus, the second embodiment of the present invention features an adapter support portion 119 provided on the head 113 of the torque wrench structure 127 and capable of receiving an adapter 121 of, for example, a monkey wrench type. The adapter 121 is provided with a plurality of recesses 122 such that the retainer pin 123 provided on the adapter support portion 119 can engage with a selected one of these recesses 122. Thus, the adapter 121 is connected to and held by the torque wrench structure 127 through the adapter support portion 119 such that the length of extension of the bolt-engaging portion 126 of the adapter from the structure 127 is adjustable.

In the torque wrench device having the described construction, the distance L0 between a point F at which manual force is exerted on the torque wrench structure 127 and a point M at which tightening torque acts in the bolt-engaging portion 126 can be freely changed. By increasing the effective length L0 of the moment arm, it is possible to set the tightening torque of the torque wrench device to a higher value.

Thus, the tightening torque can be set to a desired level by changing the distance L1 between the head pin 112 and the point M of action of the tightening torque. To this end, the user moves the retainer pin 123 against the force of the spring 124 and slidingly moves the insert portion 125 of the adapter 121 within the adapter insertion hole 120 and, after a desired length L1 is obtained, allows the retainer pin 123 to engage with one of the recesses 122 which has been brought to confront the pin 123. It will be seen that the tightening torque can be set to higher or lower level by changing the length L1 to a greater or a smaller value in the manner described.

As will be understood from the foregoing description, according to this embodiment, a torque wrench device is provided which comprises, in combination: a torque wrench structure 127 including a substantially tubular handle 111, a head 113 pivotally secured to on end of the handle 111 through a pivot pin 112, a toggle link 114 connected to the head 113, a thruster 115 coupled to the head 113 through the toggle link 114 a spring 116 which resiliently urges the thruster 45 towards the head 113, and an adapter support portion 119 formed on one end of the head 113 integrally therewith and having an adapter insertion through-hole 120 extending in parallel with the axis of the handle 111 and a retainer pin 123 resiliently driven into the adapter insertion through-hole 120; and an adapter 121 having an insert portion 125 adapted to be inserted into the adapter insertion through-hole 120, a bolt-engaging portion 126 provided on an end of the insert portion 125 for engagement with a bolt or the like to be tightened, and a plurality of recesses 122 formed in one side face of the insert portion 125 at intervals along the length of the insert portion 125.

According to this arrangement, the portion of the adapter 121 at which the adapter 121 is held by the adapter support portion 119 is adjusted to provide a required distance between the point at which the adapter 121 exerts a tightening torque and the fulcrum at which the adapter 121 is supported, thus enabling a large variation in the level of the set tightening torque. It is thus possible to obtain a much greater range of adjustment of the tightening torque as compared with known torque wrench devices.

Although a monkey-type wrench has been specifically mentioned as the adapter 121, the use of this type of adapter is only illustrative and the utility of the torque wrench device can be much more enhanced when a variety of types of wrenches are prepared to be used as the adapter 121.

Although the invention has been described through its specific forms, it is to be understood that the described embodiments are only illustrative and various changes and modifications may be imparted thereto without departing from the scope of h invention which is limited solely by the appended claims.

What is claimed is:

1. A torque wrench device comprising:

a torque wrench structure including a substantially tubular handle, a head pivotally secured to an end of said handle through a pivot pin, a toggle link connected to said head, a thruster coupled to said head through said toggle link, and a spring which is operatively coupled to said thruster and which resiliently urges said thruster towards said head; and a clamp mechanism provided on an end of said head of said torque wrench structure and capable of clamping stem portions of a variety of types of wrenches by a resilient force exerted by a spring, said clamp mechanism including a fixed frame member integral with said head and having a first contact surface for contacting one side of a stem portion of a wrench to be mounted to said torque wrench structure via said clamp mechanism, a movable frame member cooperating with said fixed frame member to clamp the wrench to said torque wrench structure, and a wrench support unitary with said fixed frame member and having a second contact surface for contacting another side of the stem portion of the wrench to be mounted, said another side being opposite said one side along the stem portion of the wrench to be mounted and said second contact surface being axially spaced from said first contact surface along the stem portion of the wrench to be mounted, whereby a torque can be applied to the wrench via said first contact surface and said second contact surface, said movable frame member being different from said fixed frame member and said wrench support.

2. A torque wrench device comprising, in combination:

a torque wrench structure including a substantially tubular handle, a head pivotally secured to an end of said handle through a pivot pin, a toggle link connected to said head, a thruster coupled to said head through said toggle link, a spring which is operatively coupled to said thruster and which resiliently urges said thruster towards said head, and an adapter support portion formed on one end of said head integrally therewith; and an adapter engaged and held by said adapter support in any one of a multiplicity of fulcrum positions each corresponding to a respective torque or moment arm, wherein said adapter support portion has an adapter insertion through-hole extending in parallel with an axis of said handle for receiving an insert portion of said adapter, said adapter support being provided with a retainer pin which resiliently extends into the adapter insertion through-hole, a bolt-engaging portion being provided on an end of said insert portion for engagement with an element to be tightened, and a plurality of recesses being formed in one side face of said insert portion at intervals along the length of said insert portion for receiving an end of said retainer pin.

* * * * *